US010696072B2

(12) United States Patent
Asamoto et al.

(10) Patent No.: US 10,696,072 B2
(45) Date of Patent: Jun. 30, 2020

(54) PRINTING APPARATUS WITH A CUTTING UNIT AND A BLOWING UNIT

(71) Applicant: SEIKO EPSON CORPORATION, Tokyo (JP)

(72) Inventors: Katsuya Asamoto, Matsumoto (JP); Junya Suzuki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/290,427

(22) Filed: Mar. 1, 2019

(65) Prior Publication Data

US 2019/0270321 A1 Sep. 5, 2019

(30) Foreign Application Priority Data

Mar. 2, 2018 (JP) ..... 2018-037272

(51) Int. Cl.
*B41J 11/66* (2006.01)
*B41J 29/17* (2006.01)
*B26D 7/18* (2006.01)

(52) U.S. Cl.
CPC ..... *B41J 11/663* (2013.01); *B41J 11/66* (2013.01); *B41J 29/17* (2013.01); *B26D 7/1854* (2013.01)

(58) Field of Classification Search
CPC ..... B41J 11/663; B41J 11/66; B41J 29/17; B26D 7/1854
See application file for complete search history.

(56) References Cited

U.S. PATENT DOCUMENTS

2003/0077100 A1* 4/2003 Hakkaku ..... B41J 11/663 400/621
2011/0298858 A1* 12/2011 Kinoshita ..... B41J 3/543 347/16
2015/0273893 A1* 10/2015 Kudo ..... B41J 11/663 347/16

FOREIGN PATENT DOCUMENTS

JP 2000-335028 A 12/2000
JP 2008-230187 A 10/2008
JP 2011-183625 A 9/2011

* cited by examiner

*Primary Examiner* — Henok D Legesse
(74) *Attorney, Agent, or Firm* — Foley & Lardner LLP

(57) ABSTRACT

A printing apparatus includes a transporting unit configured to transport a medium, a printing unit configured to perform printing on the medium, a cutting unit located downstream of the printing unit in a transport direction of the medium, and configured to cut the medium, and a blowing unit configured to deliver gas from upstream of the cutting unit in the transport direction of the medium toward downstream of the cutting unit.

6 Claims, 4 Drawing Sheets

PRINTING APPARATUS WITH A CUTTING UNIT AND A BLOWING UNIT

BACKGROUND

1. Technical Field

The invention relates to a printing apparatus.

2. Related Art

A printing apparatus configured to perform printing on a medium includes a transporting unit configured to transport a medium, a printing unit configured to perform printing on the medium, and a cutting unit configured to cut the medium. The printing unit is configured to cause liquid to adhere to the medium to perform printing on the medium. The cutting unit is provided downstream of the printing unit in a transport direction of the medium, and cuts the medium on which printing has been performed by the printing unit. A foreign material such as fine powders and fine particles is generated owing to peeling of a portion of the medium or the like during the cutting of the medium. When the foreign material adheres to the printing unit, adhesion of the liquid to the medium is hindered, causing deterioration of print quality.

JP-A-2008-230187 discloses a cutting mechanism provided in a printing apparatus. The cutting mechanism includes a cutting unit configured to cut a medium and a pressurizing unit configured to pressurize a cut position of the medium that the cutting unit is to pass through. First, the cutting mechanism causes the pressurizing unit to pressurize the medium. Then, the cutting unit cuts a portion pressurized by the pressurizing unit of the medium. In the related art, a foreign material which might have been generated from the cut position at which the cutting unit has performed cutting is pressurized beforehand by the pressurizing unit to be sealed off, and thus adherence of the foreign material to the printing unit is suppressed.

When the pressurization is performed by the pressurizing unit as in JP-A-2008-230187, a pressurized mark is to remain on the medium.

An advantage of some aspects of the invention is to provide a printing apparatus capable of suppressing generation of a pressurized mark on a medium and also suppressing adherence of a foreign material to a printing unit.

SUMMARY

Hereinafter, measures for eliminating the above-described issues and advantages of the measures will be described.

To eliminate the above-described issues, a printing apparatus includes a transporting unit configured to transport a medium, a printing unit configured to perform printing on the medium, a cutting unit located downstream of the printing unit in a transport direction of the medium, and configured to cut the medium, and a blowing unit configured to deliver gas from upstream of the cutting unit in the transport direction of the medium toward downstream of the cutting unit.

According to the above-described configuration, the gas delivered from the blowing unit flows toward downstream of the cutting unit. When the cutting unit cuts the medium and thus a foreign material is generated, this foreign material is to flow downstream in the transport direction along the gas flow. Therefore, adherence of the foreign material to the printing unit located upstream of the cutting unit in the transport direction can be suppressed. Moreover, the gas delivery by the blowing unit suppresses adherence of the foreign material to the printing unit, and thus it is unnecessary to pressurize the medium. Thus, generation of a pressurized mark on the medium can be suppressed.

In the printing apparatus, preferably, the blowing unit is configured to deliver gas from upstream of the printing unit in the transport direction of the medium.

According to the above-described configuration, since the gas can be delivered from upstream of the printing unit in the transport direction of the medium, the gas can be delivered properly from upstream of the cutting unit toward downstream of the cutting unit.

Preferably, the printing apparatus includes a controller configured to control a gas flow rate of gas delivered from the blowing unit, and in the printing apparatus, the controller increases the gas flow rate when the cutting unit cuts the medium, as compared to when the printing unit performs printing on the medium.

According to the above-described configuration, the gas flow rate of the gas delivered from the blowing unit increases during cutting of the medium, as compared to during printing on the medium, and a foreign material is likely to flow along the gas flow. Thus, adherence of the foreign material to the printing unit can be suppressed.

In the printing apparatus, preferably, the blowing unit includes a blower and a flow path in which the blower is disposed, the flow path includes a gas supply port through which gas is blown out by drive of the blower, and the gas supply port has a dimension, along a width direction of the medium, of not less than a width of the medium.

According to the above-described configuration, the gas blown out from the gas supply port is supplied over the entire width direction of the medium. Thus, adherence of a foreign material to the printing unit can be suppressed.

In the printing apparatus, preferably, the printing unit includes a guide member, a carriage configured to move along the guide member, and a head provided on the carriage, and configured to discharge liquid, and the cutting unit is provided on the carriage.

According to the above-described configuration, the carriage provided with the head can also serve as the carriage of the cutting unit. The number of parts can be reduced, as compared to the case where a carriage provided with the cutting unit is provided separately from the carriage provided with the head.

BRIEF DESCRIPTION OF THE DRAWINGS

The invention will be described with reference to the accompanying drawings, wherein like numbers reference like elements.

DESCRIPTION OF EXEMPLARY EMBODIMENTS

One exemplary embodiment of a printing apparatus will be described below.

Figure 1:
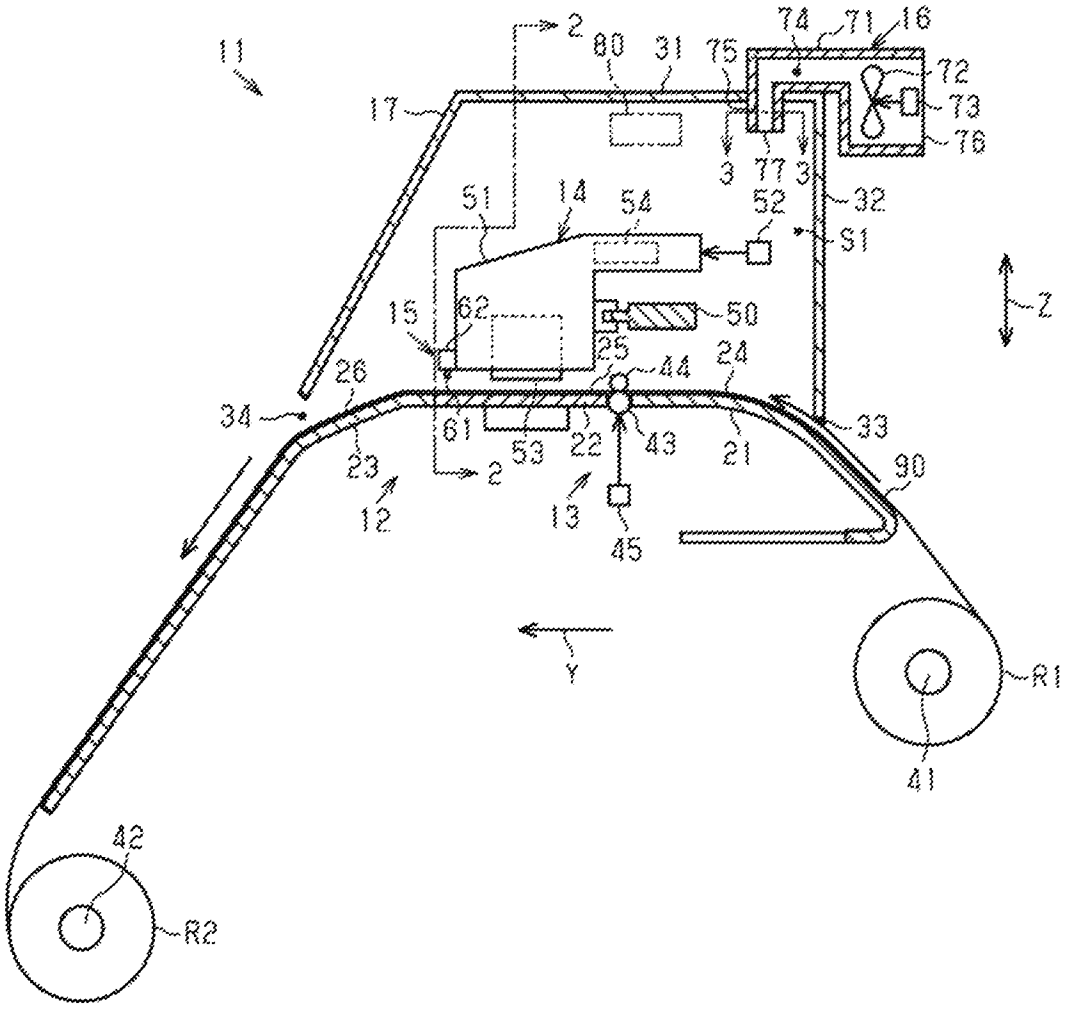
FIG. 1 is a side view schematically illustrating an exemplary embodiment of a printing apparatus.
Figure 2:
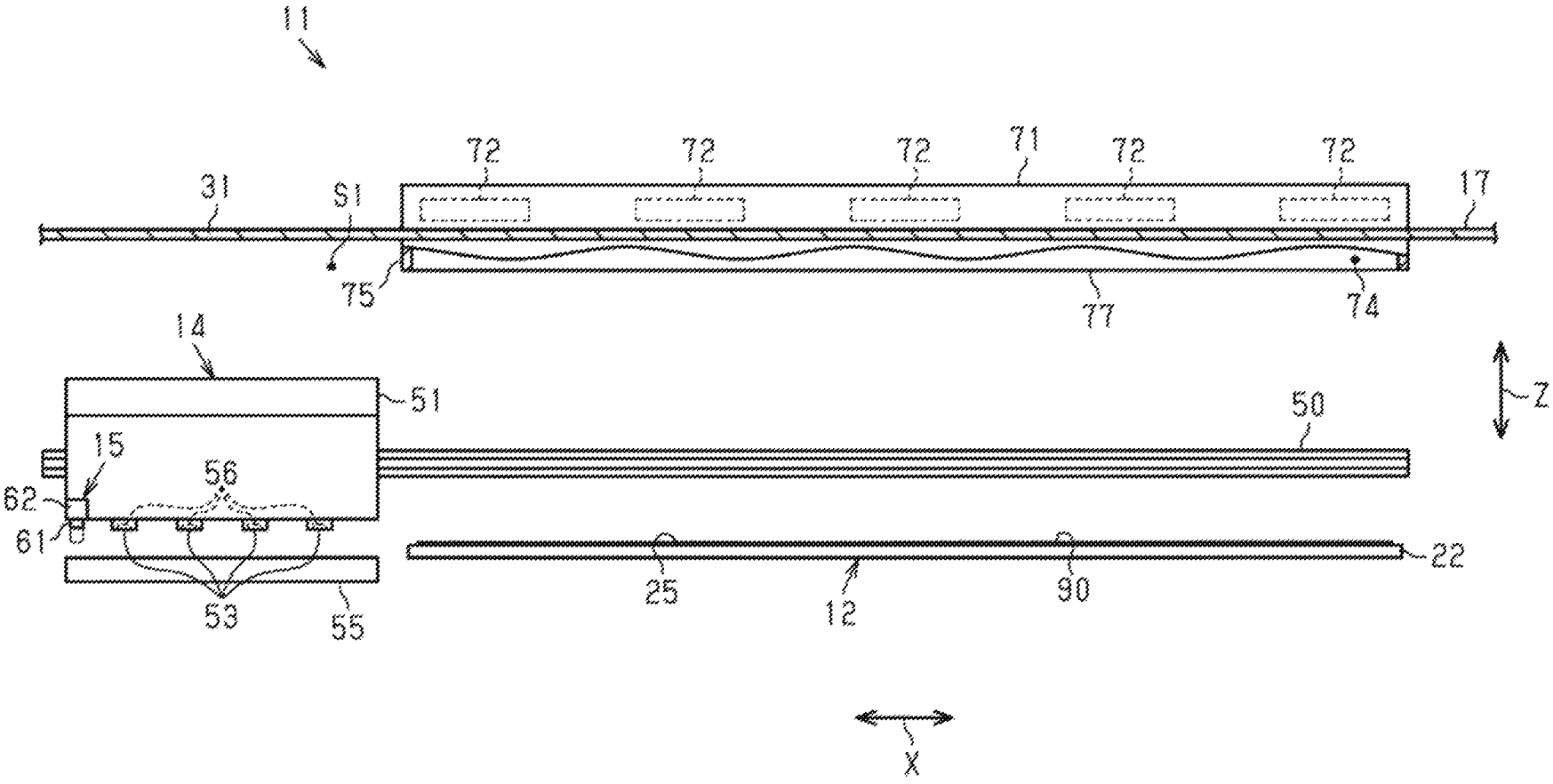
FIG. 2 is a cross-sectional view taken along line 2-2 of FIG. 1 illustrating the printing apparatus.

As illustrated in FIG. 1 and FIG. 2, a printing apparatus 11 includes a support section 12 capable of supporting a medium 90, a transporting unit 13 configured to transport the medium 90 along the support section 12, a printing unit 14 configured to perform printing on the medium 90, a cutting unit 15 configured to cut the medium 90 on which printing has been performed, and a blowing unit 16 configured to deliver gas to the medium 90. The printing apparatus 11 includes the printing unit 14 and a casing 17 configured to house the cutting unit 15. The printing apparatus 11 serves as, for example, an ink jet-type printer configured to cause an ink being an example of a liquid to adhere to print an image such as a character and a photograph on the medium 90. The medium 90 is formed of, for example, an elongated material such as continuous paper.

The support section 12 includes a first support plate 21, a second support plate 22, and a third support plate 23. The support plates 21, 22, and 23, include support surfaces 24, 25, and 26 configured to support the medium 90 transported by the transporting unit 13, respectively, and are disposed to be arranged side by side in order from upstream in the transport direction of the medium 90, and in order of the first support plate 21, the second support plate 22, and the third support plate 23. Note that, in the following description, the transport direction of the medium 90 will be described as a transport direction Y. Among the support plates 21, 22, and 23, the second support plate 22 is located to face the printing unit 14.

The casing 17 is disposed to face the support surfaces 24, 25, and 26. The casing 17 includes a top plate 31 and a side wall 32 having a frame shape and extending from a periphery of the top plate 31. The casing 17 is disposed to cause the side wall 32 to be supported by the support plates 21, 22, and 23. The top plate 31 of the casing 17 and the support surface 25 of the second support plate 22 face each other. A space surrounded by the casing 17 and the support plates 21, 22, and 23 forms an accommodation space S1 in which the printing unit 14 and the cutting unit 15 are accommodated. The casing 17 includes a supply port 33 configured to communicate an inside and an outside of the accommodation space S1 and an ejection port 34 configured to communicate the inside and the outside of the accommodation space S1. The supply port 33 and the ejection port 34 pass through the side wall 32 in the transport direction Y. In the transport direction Y, the supply port 33 is provided upstream of the ejection port 34. An opening space of the ejection port 34 is larger than an opening space of the supply port 33. The medium 90 transported by the transporting unit 13 passes through the supply port 33 to be supplied into the casing 17, and passes through the ejection port 34 to be ejected out of the casing 17.

The transporting unit 13 includes a first rotating shaft 41 located upstream of the first support plate 21 in the transport direction Y and a second rotating shaft 42 located downstream of the third support plate 23 in the transport direction Y. The first rotating shaft 41 rotatably supports a roll body R1 formed in a roll shape by lap-winding the medium 90 on which printing is to be performed. The second rotating shaft 42 rotatably supports a roll body R2 formed in a roll shape by lap-winding the medium 90 on which printing has been performed.

The transporting unit 13 includes a transport roller 43 configured to apply transport force to the medium 90, a driven roller 44 configured to press the medium 90 against the transport roller 43, and a rotation mechanism 45 configured to drive the transport roller 43. The rotation mechanism 45 includes a motor and a reducer, for example.

The printing unit 14 includes a guide member 50, a carriage 51 supported by the guide member 50, and a movement mechanism 52 configured to move the carriage 51 along the guide member 50. The guide member 50 extends in a direction intersecting the transport direction Y among directions along the support surface 25. Hereinafter, the direction intersecting the transport direction Y among the directions along the support surface 25 is defined as a scanning direction X. Note that the scanning direction X extends in the same direction as a width direction of the medium 90.

The printing unit 14 includes a head 53 capable of discharging liquid onto the medium 90, a head driving circuit 54 configured to drive the head 53, and a cap 55 configured to cap the head 53. The head 53 and the head driving circuit 54 are supported by the carriage 51. The head 53 includes a nozzle 56 capable of jetting liquid. The head 53 is capable of discharging liquid onto the medium 90 while the head 53 moves in the scanning direction X together with the carriage 51. The cap 55 is disposed adjacent to the second support plate 22 in the scanning direction X.

The cutting unit 15 is located downstream of the printing unit 14 in the transport direction Y. The cutting unit 15 includes a cutter 61 configured to cut the medium 90 and a cutter movement mechanism 62 configured to move the cutter 61. The cutter 61 and the cutter movement mechanism 62 are supported by the carriage 51. The cutter movement mechanism 62 causes the cutter 61 to move in a direction in which the carriage 51 and the support surface 25 face each other. The cutter movement mechanism 62 includes, for example, an actuator. The cutter 61 is capable of moving to a position where the cutter 61 can come into contact with the medium 90 supported by the second support plate 22 and a position where the cutter 61 does not come into contact with the medium 90 supported by the second support plate 22. The carriage 51 moves in a state where the cutter 61 is in contact with the medium 90, and thus the cutter 61 is capable of cutting the medium 90 in the width direction. Hereinafter, description will be given, assuming that a direction in which the carriage 51 and the second support plate 22 face each other is defined as a height direction Z.

The blowing unit 16 includes a duct 71 configured to communicate an inside and an outside of the casing 17, a blower 72 disposed in the duct 71, and a blower driving mechanism 73 configured to drive the blower 72. The inside of the duct 71 forms a flow path 74 through which gas flows. The blower 72 may be disposed in the flow path 74. The duct 71 is fixed to the casing 17. A portion of the duct 71 passes through the top plate 31 and protrudes into the casing 17. Assuming that a portion of the duct 71 protruding into the casing 17 is a protrusion portion 75, the protrusion portion 75 extends in the height direction Z. The flow path 74 includes an inflow port 76 configured to cause gas to flow into the flow path 74 and a gas supply port 77 through which gas is blown out by drive of the blower 72. The inflow port 76 opens to the outside of the casing 17, and the gas supply port 77 opens to the inside of the casing 17. The gas supply port 77 is an opening provided in the protrusion portion 75. The gas supply port 77 opens toward the first support plate 21. Moreover, the gas supply port 77 is located upstream of the printing unit 14 in the transport direction Y. Accordingly, the blowing unit 16 delivers gas from upstream of the printing unit 14 in the transport direction Y. The gas blown out from the gas supply port 77 is to be blown out to a surface of the medium 90. The gas blown out from the gas supply port 77 reaches the surface of the medium 90 and is then to flow along the surface of the medium 90.

Figure 3:
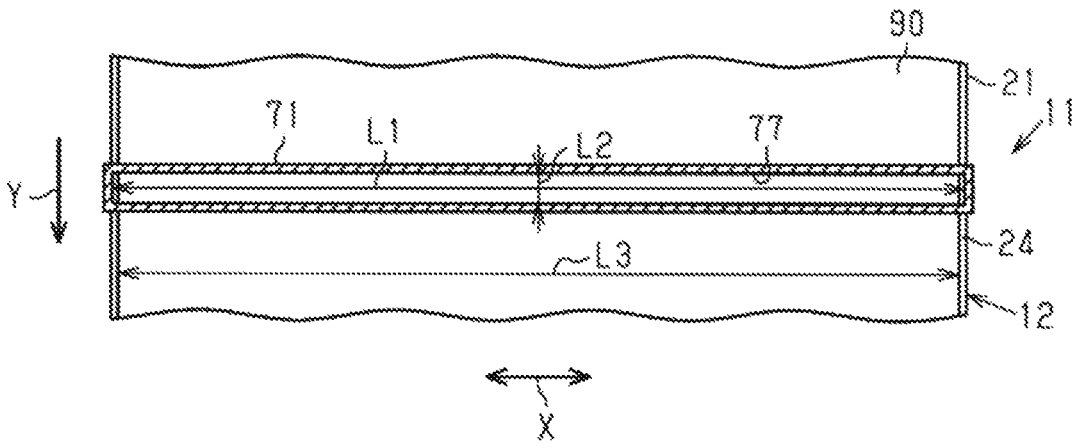
FIG. 3 is a cross-sectional view taken along line 3-3 of FIG. 1 illustrating the printing apparatus.

As illustrated in FIG. 3, the gas supply port 77 forms, for example, a rectangular opening. The gas supply port 77 extends in the scanning direction X. Specifically, a dimension L1 along the scanning direction X of the gas supply port 77 is longer than a dimension L2 along a direction orthogonal to the scanning direction X. The gas supply port 77 has the dimension L1 along the width direction of the medium 90 of not less than a width L3 of the medium 90. That is, the dimension L1 of the gas supply port 77 along the width direction of the medium 90 is made larger than the largest width size among the sizes of the medium 90 printable by the printing apparatus 11. Accordingly, the gas blown out from the gas supply port 77 is supplied over the entire width direction of the medium 90.

As illustrated in FIG. 2, a plurality of blowers 72 are provided. The blowers 72 are provided to be arranged side by side in the scanning direction X.

Next, an electrical configuration of the printing apparatus 11 will be described.

Figure 4:
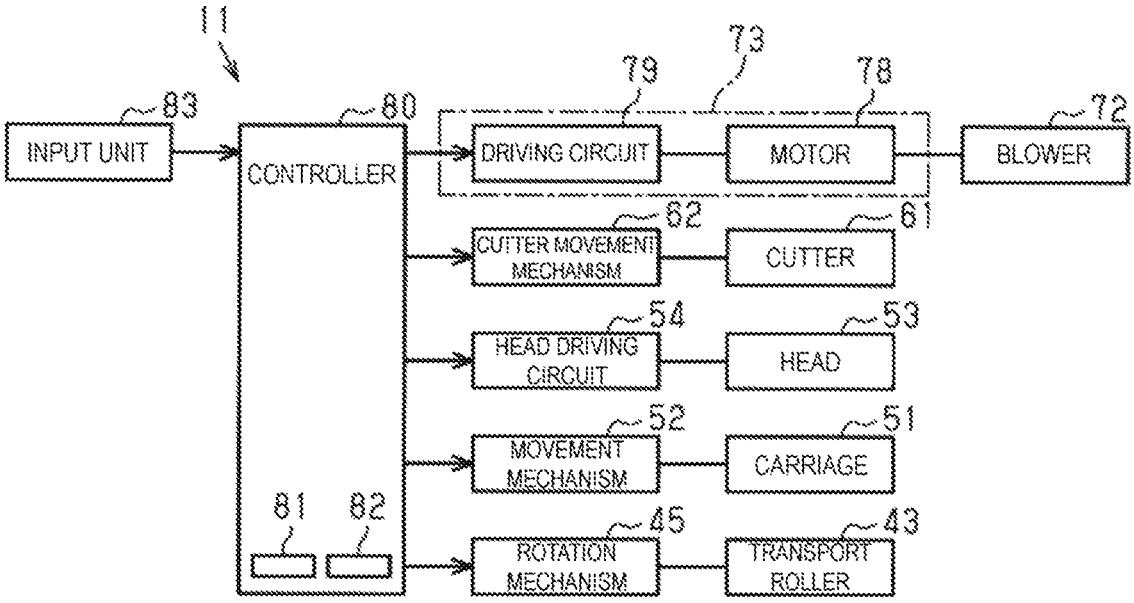
FIG. 4 is a block diagram illustrating an electrical configuration of the printing apparatus.

As illustrated in FIG. 4, the printing apparatus 11 includes a controller 80. The controller 80 includes a CPU 81 and a storage 82 including, for example, a RAM and a ROM. In the storage 82, a variety of programs for controlling the printing apparatus 11 are stored. The controller 80 may include a dedicated hardware (application specific integrated circuit: ASIC) configured to execute at least a portion of various kinds of processing. That is, the controller 80 can be constituted as one or more processors configured to operate in accordance with a computer program (software), one or more dedicated hardware circuits such as ASIC, or a circuit including a combination thereof. The processor includes a CPU and a memory such as a RAM and a ROM. The memory is configured to store a program code or a command configured to cause the CPU to execute the processing. The memory, or a computer readable medium includes any medium accessible by a general purpose or special purpose computer.

The printing apparatus 11 includes an input unit 83 coupled to the controller 80. The input unit 83 is a unit configured to instruct the controller 80 to cut the medium 90. The input unit 83 serves as, for example, an operation panel to be operated by a user of the printing apparatus 11. When the user operates the operation panel to instruct cutting of the medium 90, a cutting command is input to the controller 80.

The controller 80 is electrically coupled with the blower driving mechanism 73, the cutter movement mechanism 62, the head driving circuit 54, the movement mechanism 52, and the rotation mechanism 45. The controller 80 controls the blower driving mechanism 73, the cutter movement mechanism 62, the head driving circuit 54, the movement mechanism 52, and the rotation mechanism 45 to operate the printing apparatus 11.

When a print job is input from a terminal coupled to the printing apparatus 11 in a wired or wireless communicable manner, the controller 80 controls the rotation mechanism 45, the movement mechanism 52, the head driving circuit 54, and the blower driving mechanism 73 to perform printing on the medium 90. The print job includes various commands required for the print control, print condition information of printing conditions such as a print mode designated by the user, and print image data. The controller 80 alternately performs a transport operation in which the transporting unit 13 is caused to transport the medium 90, and a discharging operation in which the head 53 is caused to discharge ink while the carriage 51 moves in the scanning direction X, and thus printing is performed on the medium 90. When the printing is performed on the medium 90, the controller 80 drives the blower 72 to deliver gas. Note that when the printing is performed on the medium 90, the cutter 61 is located at a position where the cutter 61 does not come into contact with the medium 90 when the carriage 51 moves.

When a cut command is input, the controller 80 controls the movement mechanism 52, the cutter movement mechanism 62, and the blower driving mechanism 73 to cut the medium 90. The controller 80 causes the cutter 61 to move to a position where the cutter 61 comes in contact with the medium 90, and then moves the carriage 51 to cause the cutter 61 to cut the medium 90. When the medium 90 is cut, the controller 80 drives the blower 72 to deliver gas.

As described above, the blower 72 is driven during printing on the medium 90 and also during cutting of the medium 90. The controller 80 makes the gas flow rate of the gas delivered from the blowing unit 16, that is, a drive amount of the blower 72 different between during printing on the medium 90 and during cutting of the medium 90. Specifically, the blower driving mechanism 73 includes a motor 78 configured to operate the blower 72 and a driving circuit 79 configured to control the rotation number of the motor 78. The driving circuit 79 includes a motor driver configured to PWM-control the motor 78 to control the rotation number of the motor 78. The controller 80 controls a duty ratio to control the rotation number of the motor 78, and thus controls the gas flow rate of the blowing unit 16. Specifically, when the controller 80 gives a command to the driving circuit 79, the driving circuit 79 generates a pulse-like voltage according to the command. This voltage is applied to the motor 78 to drive the motor 78. The duty ratio means a ratio of on-pulse time per control cycle. The controller 80 makes the duty ratio different between during printing on the medium 90 and during cutting of the medium 90. Hereinafter, description will be given in more detail.

Figure 5:
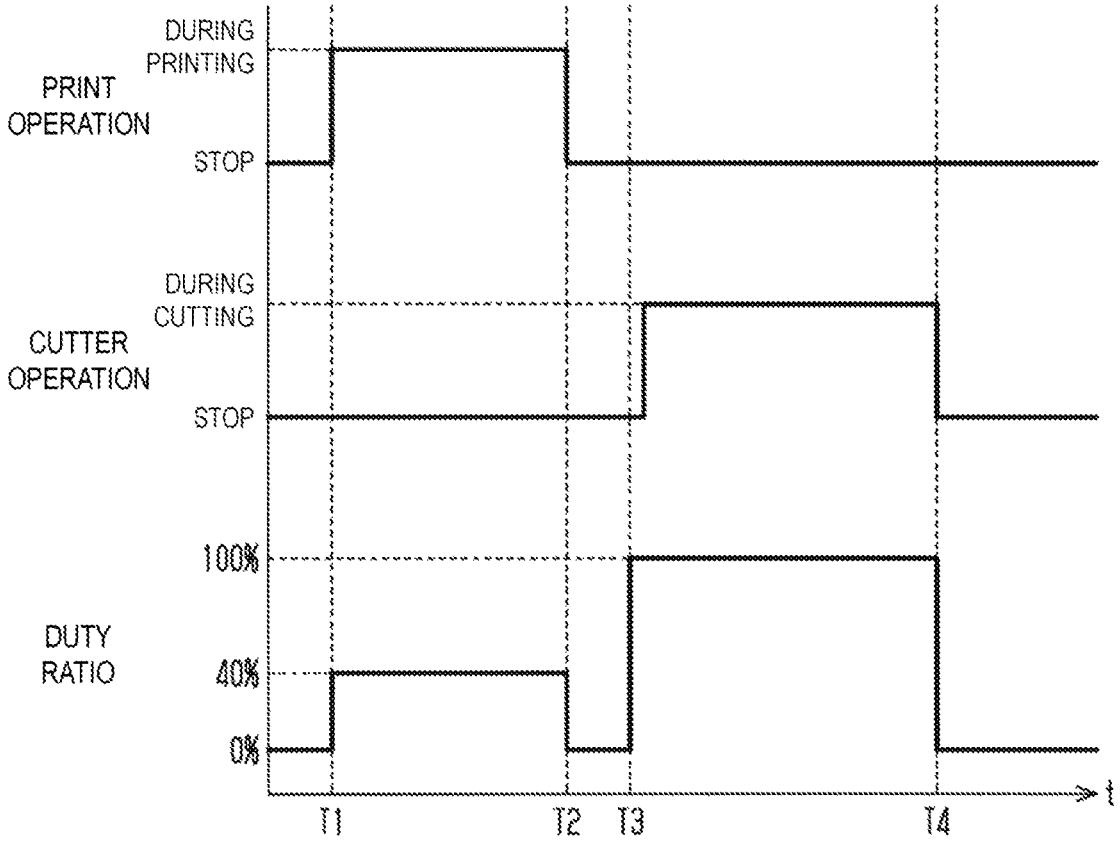
FIG. 5 is a time chart for explaining processing performed by a controller.

As illustrated in FIG. 5, when a print job is input at time T1, printing on the medium 90 is started. During the printing on the medium 90, the controller 80 sets the duty ratio of the driving circuit 79 at 40%. When the printing on the medium 90 ends at time T2, the controller 80 sets the duty ratio of the driving circuit 79 at 0%. That is, the blower 72 is caused to stop.

When a cut command is input at time T3, the duty ratio of the driving circuit 79 is set at 100%. Then, the controller 80 causes the medium 90 to be cut. Depending on responsiveness of the blower 72, it takes certain time after the duty ratio of the driving circuit 79 is set at 100% for the drive amount of the blower 72 to follow up the amount corresponding to the duty ratio. Thus, the cutting of the medium 90 is to be executed with an interval after the duty ratio of the driving circuit 79 has been set at 100%.

When the cutting of the medium 90 ends at time T4, the controller 80 sets the duty ratio of the driving circuit 79 at 0%. That is, the blower 72 is caused to stop.

The controller 80 causes the gas flow rate to increase when the cutting unit 15 cuts the medium 90, as compared to when the printing unit 14 performs printing on the medium 90.

Next, action of the printing apparatus 11 will be described.

When the printing unit 14 performs printing on the medium 90 and then a cut command is input to the controller 80, the controller 80 causes the cutting unit 15 to cut the medium 90. When the medium 90 is cut, a foreign material such as fine powders and fine particles is generated. At this time, since the head 53 and the medium 90 are electrically charged, force attracting the foreign material toward upstream in the transport direction Y owing to the Coulomb force is to be generated.

When the controller 80 causes the cutting unit 15 to cut the medium 90, the controller 80 drives the blower 72. When the blower 72 is driven, the gas flowing into the duct 71 out of the casing 17 is to be delivered into the casing 17. Here, when the gas is supplied into the casing 17, a pressure inside the casing 17 becomes higher than a pressure outside the casing 17. Owing to this pressure difference, the gas inside the casing 17 is to be discharged to the outside of the casing 17. The gas inside the casing 17 is discharged from the supply port 33 and the ejection port 34 communicating the inside and the outside of the casing 17.

Since the opening space of the ejection port 34 is larger than the opening space of the supply port 33, when the gas is supplied into the casing 17, the gas is to be discharged more from the ejection port 34 than the supply port 33. Accordingly, in the accommodation space S1, an airflow flowing from the gas supply port 77 toward the ejection port 34 is generated. The gas blown out from the gas supply port 77 is guided by the protrusion portion 75 to the medium 90 to reach the surface of the medium 90, and is then to flow along the surface of the medium 90 toward the ejection port 34. That is, the gas delivered from the blowing unit 16 is to flow from upstream in the transport direction Y toward downstream of the cutting unit 15. When the cutting unit 15 cuts the medium 90 and thus a foreign material is generated, this foreign material is to flow downstream in the transport direction Y along the gas flow. A drive amount of the blower 72 may be set, on the assumption of force attracting a foreign material toward upstream in the transport direction Y, to make force greater than this force to act on the foreign material.

Moreover, the gas flow rate during cutting of the medium 90 is larger than the gas flow rate during printing on the medium 90. This is because the gas delivery performed during printing and the gas delivery performed during cutting are different in a purpose. During printing on the medium 90, the blower 72 delivers gas to promote drying of liquid. In this case, when the gas flow rate of the gas delivered from the blower 72 excessively increases, deterioration of print quality is caused. Thus, the gas flow rate is set not to affect print quality. In contrast, during printing on the medium 90, the blower 72 delivers gas to prevent a foreign material generated through cutting by the cutter 61 from adhering to the head 53. At the stage of cutting of the medium 90, the medium 90 is dried, and it is assumed that even when the gas flow rate increases, the gas flow rate does not affect print quality. Thus, adherence of a foreign material to the head 53 or the medium 90 due to an increase in the gas flow rate is suppressed.

Therefore, according to the exemplary embodiment described above, the following effects can be obtained.

(1) The gas delivered from the blowing unit 16 flows toward downstream of the cutting unit 15. When the cutting unit 15 cuts the medium 90 and thus a foreign material is generated, this foreign material is to flow downstream in the transport direction Y along the gas flow. Therefore, adherence of the foreign material to the printing unit 14 located upstream of the cutting unit 15 in the transport direction Y can be suppressed. Moreover, the gas delivery by the blowing unit 16 suppresses adherence of the foreign material to the printing unit 14, and thus it is unnecessary to pressurize the medium 90. Thus, generation of a pressurized mark on the medium 90 can be suppressed.

(2) Since the gas can be delivered from upstream of the printing unit 14 in the transport direction Y of the medium 90, the gas can be delivered properly from upstream of the cutting unit 15 toward downstream of the cutting unit 15.

(3) The gas flow rate of the gas delivered from the blowing unit 16 increases during cutting of the medium 90, as compared to during printing on the medium 90, and a foreign material is likely to flow along the gas flow. Thus, adherence of the foreign material to the printing unit 14 can be suppressed.

(4) The gas blown out from the gas supply port 77 is supplied over the entire width direction of the medium 90. Thus, adherence of a foreign material to the printing unit 14 can be suppressed.

(5) The carriage 51 provided with the head 53 can also serve as the carriage of the cutting unit 15. The number of parts can be reduced, as compared to the case where a carriage provided with the cutting unit 15 is provided separately from the carriage 51 provided with the head 53.

(6) The blower 72 configured to dry the medium 90 can also serve as a blower configured to suppress adherence of a foreign material to the printing unit 14. The number of parts can be reduced, as compared to the case where a dedicated member configured to suppress adherence of a foreign material to the printing unit 14 is provided.

(7) Since a foreign material flows along the gas flow in the transport direction Y, the foreign material is also less likely to adhere to the medium 90 located upstream of the cutting unit 15 in the transport direction Y. In a case where a foreign material adheres to the medium 90, an issue similar to in the case where a foreign material adheres to the printing unit 14 may occur. Adherence of the foreign material to the medium 90 is suppressed, and thus deterioration of print quality can be suppressed.

Note that it is also conceivable that the medium 90 is cut and then the medium 90 is transported by a predetermined amount in the transport direction Y to prevent printing from being performed on a portion to which a foreign material is assumed to adhere. However, in this case, the printing is not performed on the medium 90 having been transported by a predetermined amount, and thus a loss of the medium 90 occurs.

In contrast, in the exemplary embodiment, the gas delivery by the blowing unit 16 suppresses adherence of a foreign material to the medium 90, and thus a loss of the medium 90 is less likely to occur.

Note that the above-described exemplary embodiment may be modified as the following modified examples. Moreover, any of the configurations in the exemplary embodiment and configurations in the following modified examples may optionally be combined or the configurations in the following modified examples may optionally be combined to each other.

The printing apparatus 11 may include a carriage for the cutting unit 15. That is, the carriage provided with the cutting unit 15 may be provided separately from the carriage 51 provided with the printing unit 14. In this case, the printing apparatus 11 includes a guide member configured to guide movement of the carriage for the cutting unit 15, and a movement mechanism configured to move the carriage for the cutting unit 15. In a case where the printing apparatus 11 includes the carriage for the cutting unit 15, a position of the cutter 61 may be fixed at a position where the cutter 61 comes into contact with the medium 90 by the movement of the carriage. That is, the cutting unit 15 may include the cutter 61 alone.

When the carriage provided with the cutting unit 15 is provided separately from the carriage 51 provided with the printing unit 14, a relative position between the cutting unit 15 and the printing unit 14 varies, and thus a foreign material generated through cutting is less likely to adhere to the printing unit 14.

The blowing unit 16 may not include the flow path 74. For example, the blower 72 is attached to the casing 17 to cause the gas delivery direction of the gas delivered by drive of the blower 72 to coincide with a direction directed to the medium 90. Accordingly, the gas is to be delivered to the medium 90 without passing through the flow path 74.

The gas supply port 77 may have the dimension L1 along the width direction of the medium 90 shorter than the width L3 of the medium 90. Even in this case, considering that gas blown out from the gas supply port 77 diffuses, the gas can be supplied over the entire width direction of the medium 90 by adjustment of a distance from the gas supply port 77 to the medium 90.

The gas supply port 77 may be formed in any shape such as an oval shape.

A gas flow rate of the gas delivered by the blowing unit 16 during printing on the medium 90 may be set equal to gas flow rate during cutting of the medium 90. That is, a blower configured to be driven by a constant drive amount may be used as the blower 72. Moreover, the gas flow rate during printing on the medium 90 may be set less than the gas flow rate during cutting of the medium 90. Note that in any of the above-described cases, the gas flow rate during printing on the medium 90 is set not to affect print quality. Moreover, the gas flow rate during cutting of the medium 90 is set to cause force greater than force attracting a foreign material toward upstream in the transport direction Y to act on the foreign material.

The blowing unit 16 may deliver gas from downstream of the printing unit 14 in the transport direction Y of the medium 90. In this case, gas flow direction and the like are set to cause the gas delivered by the blowing unit 16 to flow from upstream of the cutting unit 15 in the transport direction Y toward downstream of the cutting unit 15.

The flow path 74 may be partitioned by a wall portion of the casing 17.

The cut command may be incorporated in the print job. In this case, the controller 80 causes printing to be performed on the medium 90 in accordance with the print job, and then causes the medium 90 to be cut.

The number of the blowers 72 may be singular.

The driving circuit 79 may be configured to control a voltage supplied to the motor 78 to control a drive amount of the blower 72.

The liquid discharged by the printing unit 14 is not limited to ink, and may be, for example, a liquid material including particles of a functional material dispersed or mixed in liquid. For example, the printing unit 14 may discharge a liquid material including a material such as an electrode material or a color material (pixel material) used in manufacture of liquid crystal display, an electroluminescent (EL) display, and a surface emitting display in a dispersed or dissolved form.

The printing apparatus 11 may be a page printer configured to perform printing page-by-page.

This application claims priority under 35 U.S.C. § 119 to Japanese Patent Application No. 2018-037272, filed Mar. 2, 2018. The entire disclosure of Japanese Patent Application No. 2018-037272 is hereby incorporated herein by reference.

What is claimed is:

1. A printing apparatus comprising:

a transporting unit configured to transport a medium;

a printing unit configured to perform printing on the medium;

a cutting unit located downstream of the printing unit in a transport direction of the medium, and configured to cut the medium;

a casing configured to house the cutting unit and the printing unit and comprising a supply port and an ejection port through which the medium passes, wherein the supply port is positioned upstream of the ejection port and an opening of the ejection port is larger than an opening of the supply port; and a blowing unit configured to deliver gas from upstream of the cutting unit in the transport direction of the medium toward downstream of the cutting unit, wherein the blowing unit passes air between an inside and an outside of the casing.

2. The printing apparatus according to claim 1, wherein the blowing unit is configured to deliver gas from upstream of the printing unit in the transport direction of the medium.

3. The printing apparatus according to claim 1, further comprising a controller configured to control a gas flow rate of gas delivered from the blowing unit, wherein the controller increases the gas flow rate when the cutting unit cuts the medium, as compared to when the printing unit performs printing on the medium.

4. The printing apparatus according to claim 1, wherein the blowing unit includes a blower and a flow path in which the blower is disposed, the flow path includes a gas supply port through which gas is blown out by drive of the blower, and the gas supply port has a dimension, along a width direction of the medium, of not less than a width of the medium.

5. The printing apparatus according to claim 1, wherein the printing unit includes a guide member, a carriage configured to move along the guide member, and a head provided on the carriage, and configured to discharge liquid, and the cutting unit is provided on the carriage.

6. A printing apparatus comprising:

a transporting unit configured to transport a medium;

a printing unit configured to perform printing on the medium;

a cutting unit located downstream of the printing unit in a transport direction of the medium, and configured to cut the medium;

a blowing unit configured to deliver gas from upstream of the cutting unit in the transport direction of the medium toward downstream of the cutting unit; and a controller configured to control a gas flow rate of gas delivered from the blowing unit, wherein the controller increases the gas flow rate when the cutting unit cuts the medium, as compared to when the printing unit performs printing on the medium.

* * * * *